United States Patent [19]

Walter

[11] 4,417,557

[45] Nov. 29, 1983

[54] FEED AND DRAIN LINE DAMPING IN A FUEL DELIVERY SYSTEM

[75] Inventor: Richard P. Walter, Southfield, Mich.

[73] Assignee: The Bendix Corporation, Southfield, Mich.

[21] Appl. No.: 289,012

[22] Filed: Jul. 31, 1981

[51] Int. Cl.[3] ..... F02B 3/00

[52] U.S. Cl. ..... 123/467; 123/447; 123/446; 123/456; 239/90

[58] Field of Search ..... 123/467, 450, 447, 446, 123/500, 501, 502, 506, 456; 239/90, 91, 93, 95, 96, 533.5

[56] References Cited

U.S. PATENT DOCUMENTS

| | | | |
|---|---|---|---|
| 3,587,547 | 6/1971 | Hussey | 123/447 |
| 4,184,459 | 1/1980 | Ishii | 123/467 |
| 4,235,374 | 11/1980 | Walter et al. | 123/456 |
| 4,281,792 | 8/1981 | Sisson | 123/502 |
| 4,372,272 | 2/1983 | Walter et al. | 123/467 |

*Primary Examiner*—William A. Cuchlinski, Jr
*Assistant Examiner*—Carl Stuart Miller
*Attorney, Agent, or Firm*—Markell Seitzman; Russel C. Wells

[57] ABSTRACT

A fuel delivery system for a diesel engine for controlling the propogation of unwanted pressure waves including a fuel pump for sequentially delivering fuel from a fuel tank to a plurality of fuel injectors through a plurality of injection lines. The system further includes a drain line, one associated with each fuel injector, that is connected to a pressure source, wherein the impedance of each drain line is equal to the impedance of its corresponding injection line. Each drain line further includes a flow restriction having an impedance which bears a preselected relationship to but different from the impedance of its corresponding drain line and a valve, connected across the flow restriction for diverting flow around the flow restriction during intervals of time when fuel is flowing from the pressure source towards a particular one of the fuel injectors.

4 Claims, 2 Drawing Figures

FEED AND DRAIN LINE DAMPING IN A FUEL DELIVERY SYSTEM

This invention relates to fuel systems for diesel engines and more particularly to fuel systems incorporating fuel injectors having a metering chamber and means for controlling the propagation of unwanted pressure waves.

BACKGROUND AND SUMMARY OF THE INVENTION

One such fuel distribution system as disclosed by Walter et al in U.S. Ser. No. 217,297 filed Dec. 17, 1980, illustrates a fuel system including a plurality of diesel fuel injectors having a metering chamber. Each diesel fuel injector further includes an intensifier piston having a capillary restrictor that is inserted within a fuel passage within the piston. The upper surface of each piston is connected to a pump via an injection or feed line while each metering chamber is connected to, via a drain line, a common manifold and to a secondary source of fuel such as a low pressure fuel accumulator. The pump is of the type that can selectively pressurize the fuel lines to periodically force the intensifier piston downward thereby initiating fuel injection. Thereafter, the pump relieves the pressure within these lines to permit the intensifier piston to move upward and to let fuel flow from the secondary fuel source into the metering chamber thereby premetering or charging the fuel injector with a predetermined quantity of fuel prior to the next injection cycle or event.

Fuel systems such as that disclosed by Walter et al generate pressure waves due to the rapid cycling of hydraulic events. If proper care is not taken to control the line dynamics, the system may operate inefficiently and reduced control of the system will result. In addition, because of the common connection of the fuel injectors at the manifold, these systems are subject to cross coupling of pressure waves between the respective drain lines.

The invention is illustrated in a fuel delivery system having metering and injection modes of operation, for injecting fuel into the combustion chambers of a diesel engine, comprising a fuel reservoir and pump means for extracting fuel from the fuel reservoir and for selectively applying pressurized fuel to one fuel injector of a plurality of fuel injectors and for selectively depressurizing a particular one of the plurality of fuel injectors wherein the pressurizing and depressurizing are performed in correspondence with the combustion process within the engine. The system further includes a plurality of fuel injectors wherein each fuel injector is adapted to inject fuel within the engine, and has a metering chamber for accepting a determinable quantity of fuel prior to delivery of the fuel to the respective combustion chambers of the engine in correspondence with the combustion process therein and a plurality of injection lines interconnecting each of the fuel injectors with the pump means, wherein each injection line is characterized in having a determinable impedance. The system additionally includes pressure source means connected to the fuel reservoir for establishing a pressure level of fuel intermediate the pressurizing and depressurizing pressure levels applied to the plurality of fuel injectors; and drain line means, for carrying fuel between each of the fuel injectors and the pressure source means including a fuel carrying conduit, one associated with each of the fuel injectors, having an impedance which bears a preselected relationship to the impedance of a corresponding one of the feedlines and, having located therein flow restricting means for restricting the flow therethrough, wherein the flow restricting means has an impedance level to flow which bears a preselected relationship to the impedance of a corresponding one of the drain lines. In addition, the drain line means further includes valve means, connected in parallel across the flow restricting means, for diverting fuel flow from the flow restricting means during intervals of time when fuel is flowing from said pressure source means towards a particular one of the fuel injectors.

DETAILED DESCRIPTION OF THE DRAWINGS

Figure 1:
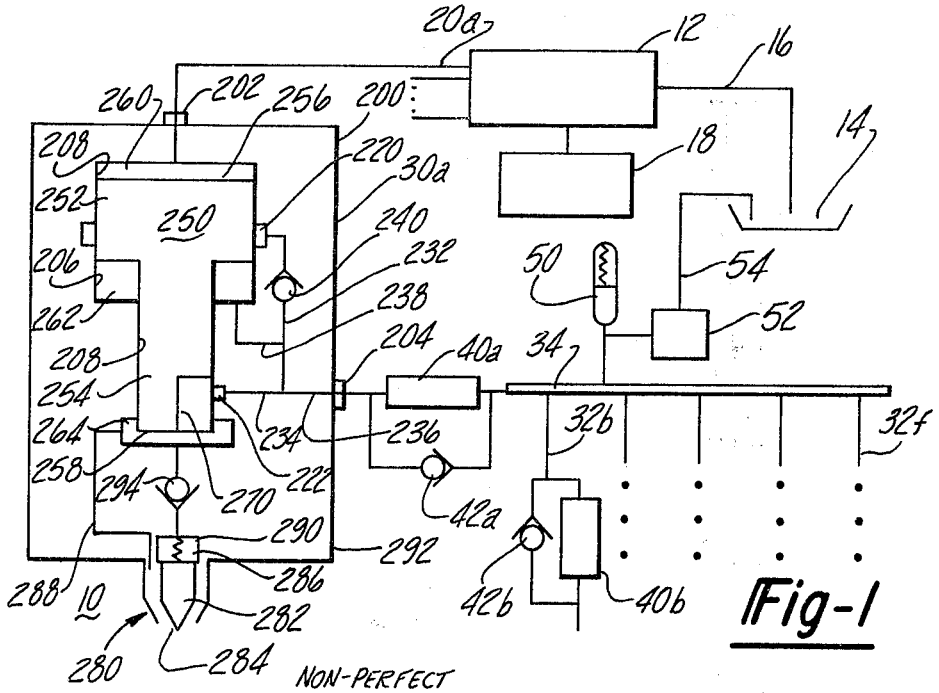
FIG. 1 illustrates a hydraulic block diagram showing a fuel system incorporating the present invention.

Reference is now made to FIG. 1 which illustrates a fuel delivery system incorporating the present invention. More specifically, there is shown a fuel delivery system 10 comprising a distributor pump 12 which removes fuel from the fuel reservoir 14 through the feedline 16 and selectively distributes the fuel, in timed correspondence to the combustion process within a diesel engine (not shown), through a plurality of feedlines 20*a–f* to a plurality of fuel injectors 30*a–f*. Each feedline 20*a–f* is characterized as having a determinable characteristic impedence to fluid flow therethrough. The pump 12 may be controlled by an electronic control unit, ECU 18, of a known variety. One such pump is the dual solenoid distributor pump disclosed by Walter et al in the commonly assigned patent application U.S. Ser. No. 217,297, filed Dec. 17, 1980 which is expressly incorporated herein by reference. Each injector 30*a–f* is further adapted to receive fuel from a fuel accumulator 50 through a respective one of the drain or metering lines 32*a–f*. Each drain line terminates in the manifold 34. In addition, each drain line 32*a–f* is characterized as having a determinable characteristic impedance to flow therethrough and in the embodiment of the invention herein illustrated, the equivalent impedance (hereinafter defined) of each drain line 32*a–f* is preferably chosen to be approximately equal to the impedance of its corresponding feedline 20*a–f*. The manifold 23 is connected to the accumulator 50. A relief valve 52 is connected between the manifold 34 and the accumulator 50 to permit excess fluid to flow into the reservoir 14 via the return line 54. Those skilled in the art will appreciate that the accumulator 50 and relief valve 52 may be incorporated within the same unit. Each drain or metering line 32*a–f* includes at its end proximate the manifold 34 a terminating device or restrictor 40*a–f* such as a laminar flow restrictor, capillary or orifice. Each restrictor 40*a–f* is chosen such that it presents an equivalent impedance to fluid flow that is equal to the characteristic impedance of its respective drain line 32. A check valve 42*a–f* is preferably placed in parallel with each restrictor 40*a–f* to permit unimpeded flow from the accumulator 50 to each injector 30*a–f*.

Inasmuch as the communication and operation of the distributor pump 12 with respect to each of the fuel injectors 30*a–f* is identical, the following description is directed to the interrelationship between the distributor pump and the fuel injector 30*a*. In addition, where appropriate, the letters designating the plurality of injectors, i.e., letters *a–f*, will not be included in the following discussion. Each injector 30 comprises a housing 200 that is adapted to receive pressurized fuel from a first source such as the distributor pump 12. This pressurized fuel is received at the input or first port 202. In addition, each injector is further adapted to receive pressurized fuel from a second source of pressure such as accumulator 50 at a second port 204. The housing 200 further includes a stepped bore 206 having received therein an intensifier piston 250. The bore 206 and piston 250 cooperate to define an upper, middle and lower variable volume chambers 260, 262 and 264 respectively. The stepped bore 206 comprises an upper first bore 208 and a lower narrower second bore 210. The housing further includes a first dump orifice 220 fabricated within the walls of the upper bore 208. A second dump orifice 222 is fabricated within the walls of the second or lower bore 210 passage. In the preferred embodiment of the invention, the first dump port 220 may comprise an annular cut-out circumscribing the walls of the upper or first bore 208. The first dump orifice 220 is connected to the fluid passages 232 having inserted therein a check valve 240 which is connected to restrict fluid flow from the second port 204 through to the first dump orifice 220. The check valve 240 is also connected to the port 204. The second dump orifice 222 is also connected to the second port 204 through the fluid passages 234 and 236. The middle chamber 264 is connected to the second port 204 through the passages 238 and 236.

The intensifier piston 250 is tightly and reciprocatively received within the stepped bore 206. The intensifier piston 250 includes an upper member 252 and a lower narrower member 254. The upper member 252 contains a pressure receiving surface 256 while the lower member 254 contains another pressure receiving surface 258. As mentioned, the intensifier piston in cooperation with the stepped bore 206, cooperates to provide a number of variable volume chambers such as an upper or primary chamber 260, a lower or metering chamber 264, and a middle or inner chamber 262. The intensifier piston 250 further includes a fluid passage 270 having one end which intersects the pressure receiving surface 258 and another end which terminates at a wall of the lower member 254. The termination of the fluid passage 270 at the wall of the lower member 254 is also configured as to connect the lower or metering chamber 264 to the dump orifice 222 when the intensifier piston 250 moves downward by a determinable amount. The dimensions of the upper member 252 of the intensifier piston 250 are such that the upper pressure receiving surface 256 of the intensifier piston 250 will uncover a portion of the dump orifice 220 at a determinable amount of downward travel thus communicating the upper chamber 260 to the orifice 220.

The injector 30 further includes a nozzle means 280 having a plunger 282 that is reciprocally situated relative to the orifice(s) 284. The plunger 282 is biased during non-injecting periods towards the orifice 284 by the biasing spring 286 to prevent the flow of fluid therefrom. The nozzle means 280 is connected to the lower chamber 262 by a fluid passage 288. The biasing spring 286 is situated within a fluid receiving chamber 290. The fluid receiving chamber 290 is connected to the port 204 via the fluid passage 292 and to the lower chamber through the check valve 294 that is connected to inhibit the flow of fluid from the lower chamber 264 into the fluid receiving chamber 290.

To initiate the injection mode of operation, the pump 12 in cooperation with the ECU 18 will sequentially pressurize the feedlines 20*a–f* therein causing the pressure within a particular upper chamber 260 of a particular injector 30 to rise. This increased pressure will force the intensifier piston 250 downward, therein compressing the fuel within the metering chamber 264 causing it to be injected into its respective combustion chamber in timed sequence with the combustion process therein. As the intensifier piston 250 approaches the bottom of its stroke, the pressure receiving surface 256 will uncover a portion of the primary dump orifice 220 therein communicating the upper chamber 260 with a respective one of the drain lines such as drain line 32*a*. This action thus relieves the pressure within the upper chamber 260 and also provides a path to dump excess pump flow to the accumulator 50. In addition, the fuel passage 270 is communicated with the secondary dump orifice 222. This of course provides a flow passage between the metering chamber and the respective drain line 32*a*. This porting action similarly relieves the pressure within the metering chamber and terminates injection. As mentioned above, when the primary dump orifice 220 is open, the excess flow from the pump will be dumped through to the accumulator 50 via the drain line 32*a*. This dumping of fuel from the upper chamber 260 through to the drain line 32 causes a pressure wave to propagate along the drain line toward the accumulator 50. The utilization of the restrictors 40*a–f* such as a laminar flow restrictor, are sized to be equal to the impedance of its corresponding drain line controls the reflections of this incident pressure wave.

Prior to the next injection mode or cycle of a particular injector, the intensifier piston 250 must be caused to move upward and fluid transmitted from the accumulator 50 into a respective metering chamber 262. The metering of fuel into a metering chamber 262 is accomplished as follows. The pump 12 causes a feedline 20 to be connected to the fuel reservoir 14, thus reducing the pressure therein. The dropping of the pressure creates a rarefaction wave in a feedline 20. Recall that at this point in time the intensifier piston 250 is at the bottom of its stroke and that the primary orifice 220 is open.

In order to cause the intensifier piston 250 to begin its upward travel rapidly, a check valve 240 has been inserted in circuit between each drain line 32 and corresponding primary dump orifice 220. The check valve 240 impedes the flow of fluid from the drain line back into the primary orifice causing the fluid flow to enter the metering chamber 264 and the inner chamber 262, thus causing the piston to move upward. Consequently, the check valve 240 provides a means for obtaining a maximum upward acceleration for the intensifier piston. If speed of response is not a factor in the particular application, the check valve 240 may be eliminated. With the check valve 240 eliminated, the intensifier piston 250 will of course start moving upward, but with a slower acceleration, therefore, the beginning of the metering mode will be slightly delayed and the metered quantity of fuel received in the metering chamber 262 will be slightly less for a given period of time.

Because of the rarefaction wave arriving from the pump to start metering, the direction of fuel flow during the metering mode is from the accumulator 50 toward a particular injector 30. In addition, to insure that the metering mode of operation starts promptly and that flow from the accumulator 50 to a particular injector 30 is not inhibited, a check valve 42 has been connected in parallel with the restrictor 40. Consequently, during the metering mode of operation, fuel will bypass the restrictor 40 and flow through the check valve 42. However, if a slower initiation of metering can be tolerated the check valve 42 may be eliminated.

The use of common components such as accumulator 50 within diesel fuel delivery systems is not new. These accumulators provide a ready source of fuel and may provide pressure regulation. However, in the configuration of the present fuel system, if each drain line 32 is terminated at the accumulator 50 as taught by the prior art, the system operation would be greatly degraded. As an example, during the termination of the injection mode, when the intensifier piston is at the bottom of its stroke, the excess flow from the pump is dumped through the primary dump orifice 220 into the accumulator 50. As this excess flow wave approaches the accumulator, the accumulator acts as a zero impedance termination which will characteristically invert the incoming pump flow wave and reflect the flow wave as a low pressure rarefaction wave back down the drain line 32. These low pressure waves cause cavitation within the drain lines which may severely limit the performance and life of the fuel system and introduce cross-coupling with the other injectors 30*b–f*.

The significance of preselecting the impedances of the components of the system can be seen from the following discussion. As a pressure wave encounters a change in impedance, a reflected wave will occur. This reflected wave may be a positive (pressure) wave or a negative (rarefaction) wave. The magnitude of the reflected wave may be calculated from equation 1.

$$\Delta P_R = \Delta P - \Delta P_A \quad (1)$$

where $\Delta P$ is the transient pressure change just upstream of an impedance mismatch.

$\Delta P_A$ is the magnitude of the pressure change due to the incident pressure wave.

$\Delta P_R$ is the magnitude of the pressure change due to the reflected pressure wave.

The relationship between the incident pressure wave $\Delta P_A$ and the resulting pressure $\Delta P$, just upstream of the impedance mismatch can be shown to be a function of the impedances before and after the mismatch and is given by equation 2.

$$\Delta P/\Delta P_A = 2/[(Z_o/Z_t)+1)] \quad (2)$$

where $Z_o$ is the upstream line impedance.

The equivalent impedance $Z_E$ of a device, as seen by the fluid flow is the sum of the impedances at the device $Z_D$ plus the downstream impedance $Z_T$:

$$Z_E = Z_D + Z_T \quad (3)$$

As an example: the characteristic impedance $Z_o$ of laminar devices such as long lines or a laminar flow restrictor is linearly related to changes in flow rate $\Delta Q_A$ and pressure $\Delta P_A$ where:

$$\Delta Q_A = \Delta P_A / Z_o \quad (4)$$

$$Z_o = \gamma c / gA \quad (5)$$

and where $\gamma$ is the specific weight of the fluid, c is the speed of sound in the fluid, g is the acceleration due to gravity, and A is the flow area.

The impedance of a non-linear device is given by:

$$Z_D = \Delta Q_T^{[1/m-1]}/(100\ A)^{1/m} \quad (6)$$

wherein $\Delta Q_T$ is the total flow through the device and is in an exponential constant relating flow and pressure for the non-linear device, m=0.5 for an orifice.

From equations 1 and 2 it can be seen that if no reflections are to occur $\Delta P$ must equal $\Delta P_A$ which implies that $Z_E$ is equal to $Z_o$. If $Z_E$ is less than $Z_o$ a positive or pressure wave is reflected, and if $Z_E$ is less than $Z_o$ a negative or refraction wave is reflected.

Figure 2:
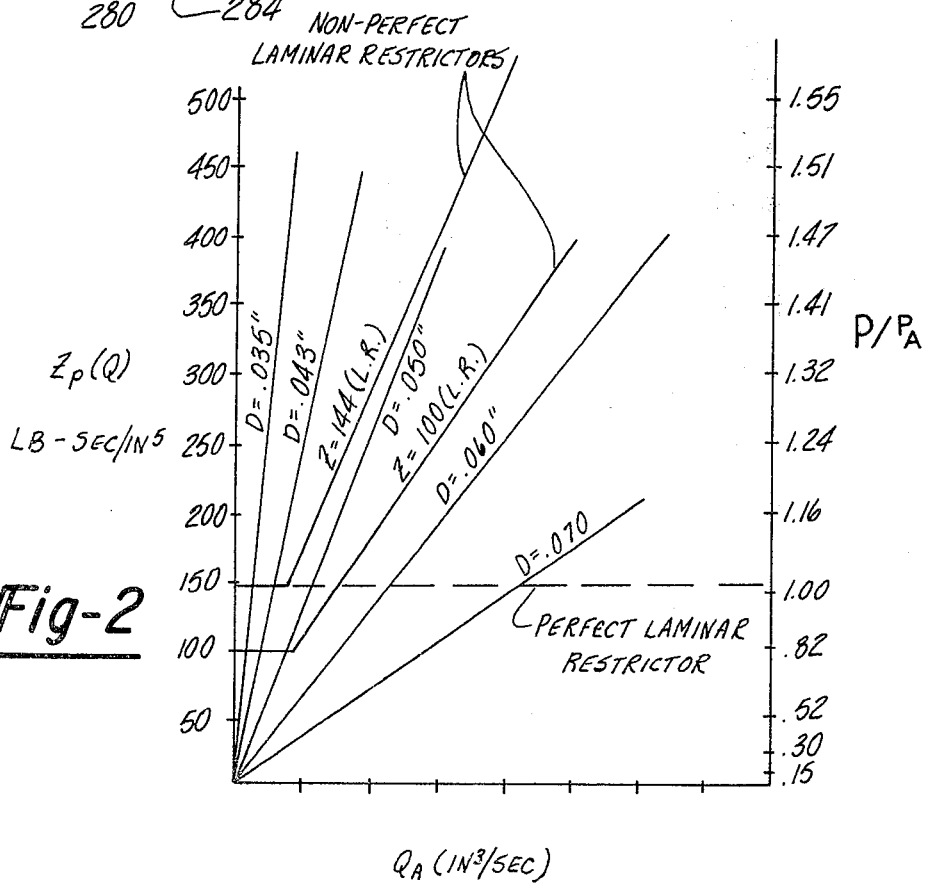
FIG. 2 is a graph illustrating relationships of characteristics for selected restrictors to terminate the drain line.

It has been found through experimentation that a perfect impedance match of the drain line to its corresponding termination device 40, while desirable, is not a requirement of this invention. That is, a determinable positive reflective wave $P_R$ can be tolerated. It has been found, in fact, that a ratio of 1.5 for $\Delta P/P_A$ was acceptable. A set of curves showing the relationship between $Z_D$ and $Q_A$, and $\Delta P/P_A$ and $Q_A$ for various restrictors is shown in FIG. 2. Also, the line for a perfect restrictor is shown.

A controlling factor regarding the maximum allowable positive pressure wave is its effect upon the position of the intensifier piston 250. To insure repeatability for both cycle-to-cycle and cylinder-to-cylinder operation, the piston should be positioned at the bottom of its stroke prior to the beginning of a metering event. Excessively large positive waves will cause the intensifier piston to be lifted off from its bottom position. As an example, if the effective impedance at the terminating device is chosen to be greater than the impedance of the drain line a positive wave will propagate from the terminating device and propagate through the drain line. The wave will enter the metering chamber 264 through the line 270. However, the wave cannot propagate through to the upper chamber 260 because of the check valve 240. In this situation a force imbalance exists across the intensifier piston. It can be seen that due to the intensification ratio of the intensifier piston the intensifier piston will not be moved upward unless the resultant pressure within the metering chamber 264, due to the positive pressure wave is significantly greater than pressure within the upper chamber 260.

If, however, the value of the effective impedance of the terminating device 40 is chosen to be less than the impedance of its corresponding drain line, a negative or rarefaction wave will propagate into the injection. In this case the negative wave will propagate through to the metering chamber as well as through the check valve 240 into the upper chamber. Consequently, negative waves will tend not to dislodge the intensifier piston from its lowest position as the wave propagates through the injector towards the pump 12. As the wave reaches the pump, it will be reflected as an amplified negative wave. The reflected negative wave, however, may be of sufficient magnitude to cause line cavitation which may result in premature system failure. Another detrimental effect of the generation of a large negative wave is that when the amplified negative wave again reaches the intensifier piston it creates a force imbalance and moves the intensifier piston from its desired position and hence effects the accuracy of subsequent metering events.

FIG. 2 illustrates the characteristics of a number of laminar restrictors which are, for purposes of this application, to be referred to as "non-perfect" laminar restrictors. A perfect laminar restrictor is a device that has the same impedance as the line it terminates and maintains that impedance over the total flow range. A non-perfect laminar restrictor is laminar only for part of the flow range. Typically, a non-perfect restrictor acts as a perfect restrictor at low flow rates and as an orifice at high flow rates. This difference between perfect and non-perfect laminar restrictors may be easily seen upon a study of FIG. 2.

In FIG. 2, a horizontal dashed line shows the characteristic of a perfect laminar restrictor as having a constant impedance which is matched to the line. That impedance in the case illustrated is approximately 144. Another curve shown on FIG. 2 is a laminar restrictor which starts at low flow rates of having an impedance of 144, thus matching the perfect laminar restrictor impedance, but then its impedance increases as the flow rate increases. The right hand axis of FIG. 2 illustrates the pressure scale which may be used to compare the performance of one restrictor relative to another. Thus, for the non-perfect restrictor which starts off having an impedance of 144, it is seen that the pressure is 1.55 times greater than the pressure experienced by the perfect restrictor.

To reduce the peak pressures, FIG. 2 illustrates a restrictor which is non-perfect in characteristic and is labeled $Z=100$ wherein the impedance starts off at 100 and is linear up to a point and then rises as flow rises. It is seen that the restrictor has some negative reflected waves but has been found that these waves probably are tolerable. From equation 2, the ratio of $\Delta P/P_A$ is calculated to be 0.82. If the device becomes non-linear for a change in flow of 4 in./cu. per second, then from the equation $\Delta Q_A=\Delta P_A/Z_o$, the incident pressure wave will be 576 psi and the maximum negative wave from equation 1 is then $-103$ psi. This condition is acceptable since the accumulator tends to maintain a minimum line pressure of 600 psi, thereby preventing cavitation.

As is further seen from FIG. 2, the non-perfect laminar restrictor with $Z=100$ did reduce the peak pressure amplification from 1.55 to 1.37 at $Z_A=20$ in./cu. per second thus an advantage has been gained by carefully selecting non-perfect restrictor. While a preferred embodiment has been illustrated and described it should be understood that many other modifications could be made to the preferred embodiment without it departing from the spirit and scope of the following claims.

Having thus described the invention, what is claimed is:

1. A fuel delivery system having metering and injection modes of operation, including at least one fuel injector having a metering chamber for injecting fuel into the combustion chambers of an engine from a reservoir comprising:

pump means for selectively applying pressurized fuel from the reservoir to at least one fuel injector during an injection mode and for selectively depressurizing during a metering mode, said pressurizing and depressurizing are performed in correspondence with the combustion process within the engine;

a feedline interconnecting the fuel injector with said pump means, wherein said feedline is characterized as having a determinable impedance;

pressure source means for establishing a pressure level of fuel intermediate the pressurizing and depressurizing pressure levels applied to the fuel injector and for supplying a determinable quantity of fuel to the metering chamber; and drain line means for carrying fuel between the fuel injector and said pressure source means including a fuel carrying conduit having an impedance which bears a preselected relationship to and different from the impedance of said feedline and having located therein flow restricting means for restricting the flow therethrough, said flow restricting means has an impedance level to flow which bears a preselected relationship to and different from the impedance of said conduit wherein said drain line means further includes valve means, connected in parallel across said flow restricting means, for diverting fuel flow from said flow restricting means during intervals of time when fuel is flowing from said pressure source means towards a particular one of said fuel injectors.

2. The system as defined in claim 1 wherein said valve means comprises a check valve.

3. The system as defined in claim 1 wherein said pressure source means comprises an accumulator for receiving the excess flow from said pump means.

4. The system as defined in claim 3 wherein said pressure source means further includes a relief valve for returning excess fuel to said fuel reservoir.

* * * * *